United States Patent [19]

Wonisch

[11] 4,068,516

[45] Jan. 17, 1978

[54] METHOD AND APPARATUS FOR HANDLING BAR-SHAPED MATERIAL

[75] Inventor: Rudolf Wonisch, Mailand, Italy

[73] Assignee: Firma Friedrich Kocks, Dusseldorf, Germany

[21] Appl. No.: 742,869

[22] Filed: Nov. 18, 1976

[51] Int. Cl.[2] ..... B21B 43/00

[52] U.S. Cl. ..... 72/201; 266/259

[58] Field of Search ..... 72/200, 201, 202, 250, 72/251; 266/259, 260; 214/1 P

[56] References Cited

U.S. PATENT DOCUMENTS

| | | | |
|---|---|---|---|
| 744,874 | 11/1903 | Neeland | 266/259 |
| 1,441,042 | 1/1923 | Thackray | 266/259 |
| 1,498,620 | 6/1924 | George | 72/202 |
| 1,606,280 | 11/1926 | Wille | 72/202 |
| 1,617,936 | 2/1927 | Bamberger | 72/200 |
| 1,962,586 | 6/1934 | Gassen | 266/259 |

FOREIGN PATENT DOCUMENTS

| | | | |
|---|---|---|---|
| 425,058 | 6/1911 | France | 266/260 |
| 1,287,544 | 1/1969 | Germany | 72/201 |
| 2,246,740 | 3/1974 | Germany | 72/201 |

*Primary Examiner*—E. M. Combs

*Attorney, Agent, or Firm*—Buell, Blenko & Ziesenheim

[57] ABSTRACT

A method and apparatus are provided for handling bar-shaped material, such as tubes, beyond a plant for manufacturing and/or machining same, comprising the steps of sub-dividing the material moving out of the plant by means of a severing device, sorting the cut lengths of material into at least two groups and feeding said sorted lengths to at least two cooling beds, conveying the cut lengths from the first cooling bed and subjecting them to substantially automatic continuous after-processing and conveying the cut lengths from the second cooling bed, after intermediate storage subjecting them at the second cooling bed to at least partially manual individual after-processing.

14 Claims, 1 Drawing Figure

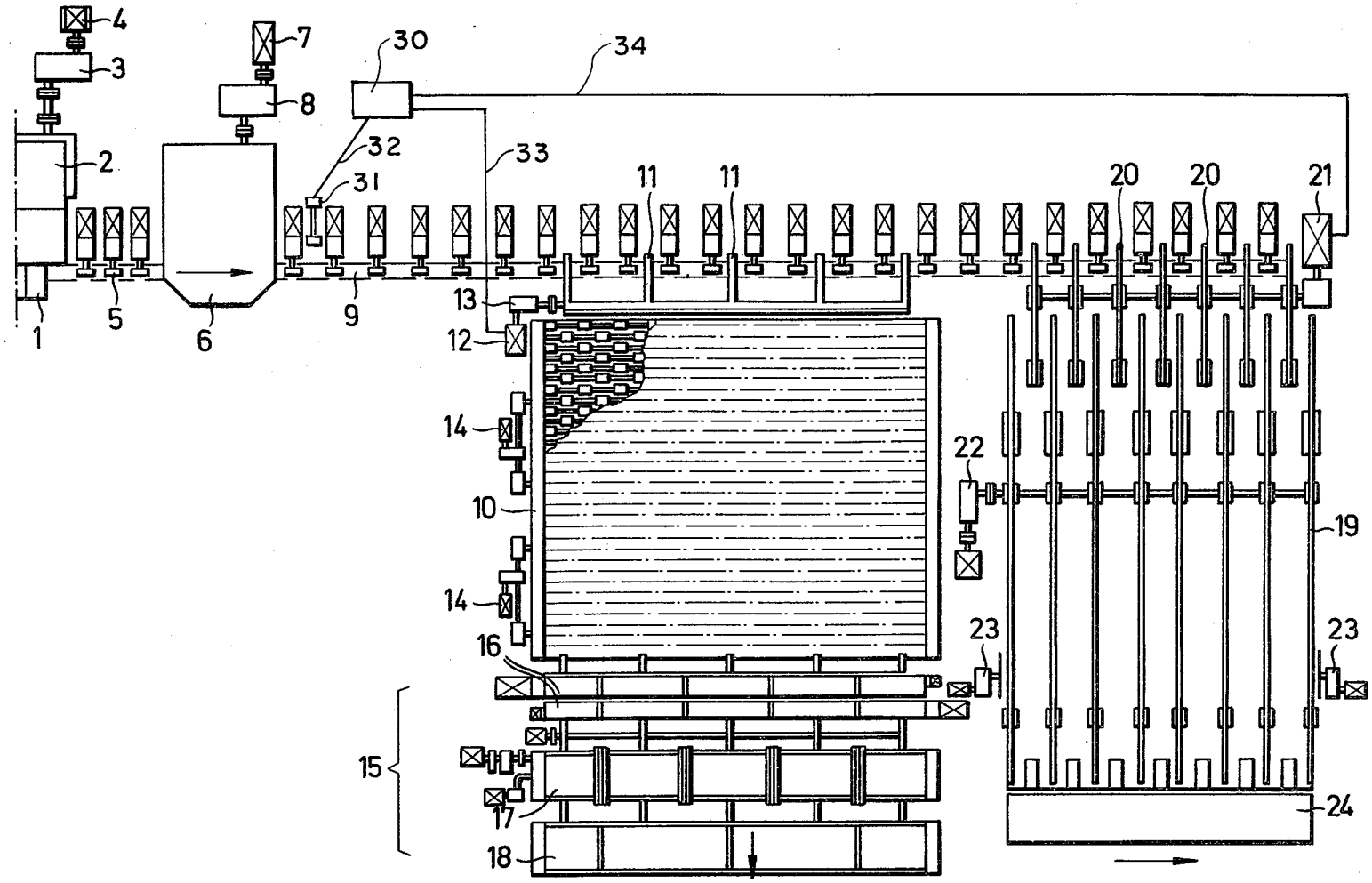
1
2
3
4
5
6
7
8
9
10
11
11
12
13
14
14
15
16
17
18
19
20
20
21
22
23
23
24
30
31
32
33
34

METHOD AND APPARATUS FOR HANDLING BAR-SHAPED MATERIAL

This invention relates to a method and an apparatus for the handling of bar-shaped material, particularly tubes, beyond a plan for manufacturing and/or machining the same, the material moving out of the plant being sub-divided by means of a severing device, and the pieces of material being fed to at least one cooling bed and being further processed and/or tested therebeyond.

In a presently known and generally used method and apparatus of this type, only a single cooling bed is used beyond the plant for producing and/or machining the material e.g., beyond a stretch reducing rolling mill. Although plants exist which are provided with a second cooling bed, this second cooling bed is not used simultaneously with the first cooling bed. With such a plant, only one or the other cooling bed can be used in accordance with the nature of the material, e.g., in accordance with the cross-sectional dimensions and the cross-sectional configuration of the material. Consequently, when producing, for example, tubes of a specific size and quality, all the pieces have to be fed by way of the same cooling bed for further processing, thus involving considerable difficulties and limiting the attainable output in an uneconomical manner.

By way of example, when manufacturing tubes, a tube is first manufactured whose length is considerably greater than the lengths which can be handled commercially. Owing to the method of manufacture, this tube length has two end portions whose wall thickness is greater than that of the centre portions of the length. Thus, one speaks of the thickened ends of the tube which are usually rejected since they are larger than the standard dimensions. Of course, they can be used for special purposes or can be further processed on special apparatus. However, these thickened ends are usually scrapped.

In any event, the thickened ends have to be severed from the tube. This might be effected by means of flying saws during the delivery of the tube from the manufacturing plant. This involves the difficulty of removing the thickened ends, which are frequently only short, from the rolling line in an operationally reliable manner at the high rolling speeds of modern rolling mills. This difficulty is caused by the fact that, owing to their short length, the ends cannot be reliably conveyed on the roller bed and jam, drop from the roller bed or get between the rollers.

Furthermore, the distance between the thickened end and the center portion of the tube is too short to eject the thickened end laterally. Moreover, the period of time between cutting the rear thickened end of the first tube and cutting the front thickened end of the following tube is too short to eject the two ends in a reliable manner.

With the high delivery speeds customary in modern manufacturing plants, considerable difficulties arise in severing the thickened ends accurately to a centimeter at the location at which the wall thickness merges into the range of tolerance which is still admissible. Since, for reasons of quality, the thickened ends must be severed in their entirety and since, for reasons of economy, satisfactory portions of the tube must not be scapped together with the thickened ends, and to avoid the difficulties mentioned above, in the known method and in the known plant the thickened end portions are not removed from the tubes until they reach the cooling bed, i.e. when the tubes are no longer moving. However, the thickened ends which have been severed, and which can be of greatly varying length, are then located on the cooling bed together with the center portions of the length of the tube, this also being the case when the thicknened ends have been severed by flying severing devices upstream of the cooling bed, since the thickened ends cannot be ejected with sufficient reliability directly after they have been severed, particularly when the tubes follow one another at short distances apart and high delivery speeds. Thus, in the known plant, the thickened ends have to be sorted out manually, this being a troublesome and time-consuming operation. When the billets to be rolled into tube lengths follow one another at, for example, three billets per minute, approximately 8000 thickened ends have to be separated as scrap in 24 hours. Furthermore, the severing of the thickened ends on the cooling bed requires a cooling bed of great width and additional severing and conveying devices.

After the thickened ends have been severed, the serviceable portions of the lengths of the tube remain on the cooling bed and also have greatly differing lengths. These differences in length cannot be avoided, since, owing to the high degree of deformation during the manufacturing process, even small differences in the weights of the billets result in differences in length of several meters, particularly in the case of small tubes having thin walls. Since the acceptance specifications and standardization prescribe specific commercial lengths, residual lengths remain after the center portions of the lengths of the tubes have been subdivided and also have to be sorted out. Approximately 4000 residual lengths are produced in 24 hours at the above-mentioned sequence of billets of, for example, three billets per minute. The residual lengths are conveyed to a residual length after-processing station or to a scrap collection point. For this purpose, and for the purpose of sorting the thickened ends, at least six workers are required over 24 hours in the known plant. These workers are also required when only the thickened ends have to be sorted.

Furthermore, the additional difficulty is encountered that, after the thickened ends have been severed, the center portions of the tubes are also of differing lengths so that their end faces do not abut flushly against the end of the cooling bed. Therefore, they first have to be collected and moved against a stop in order to be able to sub-divide them into commercial lengths with a minimum of waste. The operation of collecting and moving the tubes against a stop is discontinuous and interrupts the course of the process. Furthermore, the commercial lengths obtained then have to be collected in the form of bundles and have to be separated again for further operations such as milling the ends of the tubes, testing the tubes, and cutting threads. The residual pieces of differing lengths also have to be sorted and conveyed to a separate after-processing line in order to render them saleable. The latter operation involves a relatively large amount of manual labor and is very expensive and hinders high output.

The term "after-processing" is used herein to embrace the final operations on the work pieces needed to make them saleable items. Such final operations follow the main manufacturing step or steps and include, for example, conveying of the workpieces, sorting or segregating, machining the ends of the workpieces, and packing.

Thus, the production finishing steps in the region of the after-processing station are considerably impaired by the thickened ends and the differing residual lengths. This also applies to the thickened ends in the region of the cooling bed and therebeyond, since, in many cases they are so short that they can no longer be transported by the after-processing devices designed for greater lengths. Consequently, they have to be handled manually, thus greatly impairing the efficiency of the known after-processing equipment. The unnecessary transport of the thickened ends also results in a loss of output. Furthermore, the known plant operates uneconomically when executing orders for small quantities, since the entire plant has to be changed over in each case for the small quantities. This applies particularly when a commodity has to be manufactured in accordance with a different standard or with different dimensions. This usually means that completely different machines have to be used, and a considerable amount of conversion work has to be undertaken. The same thing can also be necessary in the case of a change in the quality of the material in which, for example, all the machining tools of the after-processing line may have to be changed and not just the rollers in the rolling mill, the machines having to be freshly set up.

For the aforementioned reasons, a largely continuously and automatically operating after-processing equipment installed beyond a continuously operating production plant can, in practice, be realized with the known means only when continuous operation can be maintained over a long period of time and when very long tubes are available. Therefore, solutions have already been proposed in which the tubes emerging from the production plant are kept at a length of approximately 180 m and are delivered onto cooling beds of corresponding length. However, these solutions are unsatisfactory since, when tubes having larger overall dimensions are produced, they are necessarily of shorter length and the very long cooling bed is not utilized to good advantage. Furthermore, the above-mentioned problem of the residual lengths and the thickened ends is only shifted to another location of the after-processing station. Thus, continuous after-processing equipment (the term also applies to largely automated and continuously operating after-processing devices), and the process steps carried out thereby are, at the most, practicable in the manner known hitherto only in extremely large production plants which produce the same commodity over long periods of time.

The object of the invention is to provide methods and apparatus which do not have the aforementioned disadvantages and which can also be used economically in medium size and small production plant.

The present invention provides a method of handling bar-shaped material, such as tubes, beyond a plant for manufacturing and/or machining same, in which method the material moving out of the plant is subdivided by means of a severing device, and the cut lengths of material are sorted and fed to at least two cooling beds and in which the cut lengths from the first cooling bed are conveyed away and subjected to substantially automatic continuous after-processing and the cut lengths from the second cooling bed, after intermediate storage are conveyed away and subjected to the second cooling bed at least partially manual individual afterprocessing.

The invention utilizes the feature that a high output can be attained in the after-processing equipment only when large quantities of commodity of substantially constant dimensions and constant quality are passed through. By utilizing the method of the present invention, this can also be achieved in average size and small production plants in that all uniform pieces of the commodity, suitable for achieving a high output in the after-processing equipment, are separated from the residual lengths and short thickened ends of the commodity upstream of the cooling bed. Thus, the uniform pieces of the commodity, which represent by far the larger quantity, are fed by way of the first cooling bed to the continuous after-processing equipment of high output arranged therebeyond, while all the residual pieces and thickened ends are fed by way of the second cooling bed to the individual after-processing equipment.

By "continuous after-processing" is meant the use of after-processing equipment through which the workpieces are passed continuously. By "individual after-processing" is meant the use of after-processing equipment which operates separately on each workpiece according to individual requirements. The working sequence in the progressive after-processing is then no longer disturbed by residual pieces and the manual intervention thus required, so that a continuous working sequence of high output is ensured in the continuous processing equipment.

Thus, pieces of material which might cause trouble do not enter this continuous process but are delivered by way of the second cooling bed to the individual after-processing equipment which, owing to the smaller quantity of pieces of material, also need have only a smaller output. This lower output meets the requirements of the individual processing of the residual lengths by virtue of the fact that manual intervention is facilitated at low throughput rates and the greater quantity of material does not pass through the individual after-processing equipment.

Thus, by the use of the method in accordance with the invention, the output of the after-processing equipment beyond the manufacturing plant is substantially improved and the thickened ends and the various residual lengths no longer have to be manually sorted out from the main mass of material on or beyond the cooling bed, so that considerable economy of labor can be realized. Orders for smaller quantities with different dimensions, constructions and materials can be handled in the meantime in an advantageous manner by way of the second cooling bed without having to convert the continuously operating continuous after-processing equipment and then having to reconvert it again after a short period of time. Furthermore, the continuous after-processing equipment can be designed in a particularly economical manner for those dimensions of the material which are most frequently manufactured in the relevant plant. In contrast to the known constructions, the continuous after-processing equipment with its expensive devices then need not be constructed such that it can operate in compliance with the entire program of the preceding production plant (this being difficult in any event) and, for example, can be designed such that only tubes up to specific dimensions most frequently occurring can be processed, while the infrequent orders for tubes of different dimensions, constructions and quality are handled by way of the second cooling bed and the individual after-processing equipment. However, this advantageous possibility, which is of primary importance for plant having a large program, is of secondary importance, since, in the present invention, the primary concern is to use the two cooling beds simultaneously and to separate the commercial lengths from the residual lengths before they are transferred to the cooling beds and to further process them separately.

A substantial advantage of the method of the present invention also resides in the fact that the entire plant is safeguarded to a greater extent against faults in the after-processing equipment, since further processing can then be effected by way of the second cooling bed or a further cooling bed. Furthermore, reconstruction or conversions in an after-processing line can be effected without closing down the entire plant.

When severing unserviceable end portions of the material, it is particularly advantageous if the severing device severs such an end portion together with a section of servicable material of at least commercial length and feeds it to the second cooling bed and to the individual after-processing equipment arranged therebeyond where the unserviceable end portion is then severed and sorted. This has the advantage that the unserviceable end portions of the material are severed on the cooling bed whilst the tube is stationary, so that it is possible to sever the unserviceable end portions accurately to a centimeter, i.e., substantially without loss. The commercial length of the material then remaining can either be further processed in the individual after-processing equipment or can be transferred to the adjacent continuous after-processing equipment. The relatively short unserviceable end portions can then be removed without difficulty in the after-processing equipment since they are severed at this location whilst the material is stationary. Alternatively, they can be fed for special further processing, this being effected automatically if required. In any event, the initially mentioned difficulties, which occur owing to the short lengths of the thickened unseviceable ends, are avoided. A further advantage is that, with such a procedure, the front end and rear end commercial lengths of a tube which are still serviceable, but which already have a greater wall thickness, can be associated with the individual after-processing equipment, while only the qualitatively superior center longitudinal portions of the tube are delivered to the substantially automatically operating continuous after-processing equipment by way of the first cooling bed. These pieces of material are not only the best which are chosen with respect to quality, but, owing to their homogeneity and the high number of pieces per unit of time, they fully correspond to the ideal conditions for a continuous after-processing equipment, so that high output is obtainable.

The invention includes apparatus for handling cut lengths of bar-shaped material discharged from a plant for manufacturing and/or machining same comprising first and second cooling beds, means for selectively transferring the cut lengths to the first and second cooling beds, continuous after-processing equipment having substantially automatically operating devices and disposed to receive and process cut lengths from the first cooling bed, and individual after-processing equipment disposed to receive and process (with manual intervention) cut lengths from the second cooling bed.

It is also possible to provide more than two cooling beds and thus to provide a larger number of continuous after-processing stations and also a larger number of individual after-processing stations. Otherwise, it is not essential to construct the first cooling bed, arranged beyond the plant for producing and/or processing the material, as a cooling bed for the continuous after-processing equipment, although this is usually more advantageous, since the greater quantity of the material passes over this cooling bed and then takes the shorter path.

In an advantageous embodiment of the invention, the first cooling bed is in the form of a straightening cooling bed, preferably in the form of a straightening roller cooling bed. This has the advantage that the material is substantially straight before it is conveyed to the continuous after-processing equipment where trouble which would be caused by bent pieces of material is avoided. Furthermore, with cooling beds of this type, particularly with a straightening roller cooling bed, it is possible to achieve a considerable storage effect, so that the cooling bed itself acts as a buffer and can compensate for differing station times between the producing and processing plant arranged in advance thereof and the after-processing equipment arranged therebeyond. This also provides a limited possibility of assistance in bypassing temporary faults upstream and downstream of the cooling bed.

It is advisable to arrange a computer and associated measuring, testing and weighing devices upstream of the cooling beds in the delivery direction of the material, and to control the deflectors, transfer levers, ejectors or the like, upstream of the cooling beds by means of the computer in dependence upon the nature of the pieces of material.

The invention is further described, by way of example, with reference to the accompanying drawing which is a diagrammatic plan view of a bar material handling apparatus according to the invention.

Referring to the drawing, a stretch-reducing rolling mill is designated 1 and its illustrated rear portion is provided with drive transmissions 2 and 3 and a motor 4. The tubes emerging from the stretch-reducing rolling mill 1 are fed by way of a short roller bed 5 to a severing device in the form of a flying saw 6 where the tube can be cropped and sub-divided. The saw 6 is driven by a motor 7 by way of a transmission unit 8.

A roller bed 9 comprising a large number of individual driven rollers conveys the portions of the tube to a straightening roller cooling bed 10 onto which they are deposited by means of transfer levers 11. The transfer levers 11 are driven by means of a motor 12 by way of a transmission unit 13. Drive units 14 drive the rollers of the straightening roller cooling bed 10, which straightens the tubes, and the straightening rollers convey the tubes to the end of the cooling bed 10 from where the tubes are conveyed to continuous after-processing equipment 15 which operates substantially automatically, the tubes being made ready for sale.

However, the transfer levers 11 deposit onto the cooling bed 10 only those longitudinal portions of the material which fully correspond to the conditions of the continuous after-processing equipment 15 arranged beyond the cooling bed 10. In the present embodiment, the continuous after-processing equipment 15 comprises an end milling machine 16, a pressure tester 17 and a packing machine 18 from which the tubes are removed for dispatch. The machines 16, 17 and 18 operate substantially automatically as also do their feed and transfer devices.

The other pieces of tube remain on the roller bed 9 in the first instance and are conveyed by way of the latter to the region of the cooling bed 9 which is in the form of a grate-type cooling bed. They are conveyed transversely from the roller bed 9 to the grate-type cooling bed 19 by means of transfer levers 20, the levers 20 being driven by means of a drive unit 21. The drive for the grate-type cooling bed 19 is designated 22. Individual after-processing equipment for the material fed to the cooling bed 9 includes severing devices 23 for the severing of thickened ends are located adjacent to the grate-type cooling bed 19.

The material is conveyed in the direction of the arrow to other devices (not shown) of the individual after-processing equipment from a collecting trough 24 located at the end of the grate-type cooling bed 19. The individual after-processing equipment and the continuous after-processing equipment 15 may be constructed in a large variety of ways. Such equipment may comprise known machines and devices, themselves not the subject of the present invention. The individual after-processing equipment is not fully automated in that at least one of the after-processing steps is manual or manually controlled in accordance with the individual requirements.

In one form of this apparatus, a computer 30 of known design may be connected to a measuring device such as an electric eye arrangement 31 of known type by line 32 and as a result of the indicated measurements activate drive motors 12 or 21 through lines 33 and 34 depending upon the indicated measurement. As indicated above a weighing device or other measuring or testing apparatus can be substituted for the electric eye arrangement 31.

While I illustrated and described certain presently preferred practices and embodiments of my invention in the foregoing specification, it will be understood that this invention may be otherwise embodied within the scope of the following claims.

I claim:

1. A method of handling bar-shaped material, such as tubes, beyond a plant for at least one of manufacturing and machining the same, comprising the steps of subdividing the material moving out of the plant by means of a severing device, sorting the cut lengths of material into at least two groups, each group of generally similar character, feeding said sorted lengths to at least two spaced cooling beds, one group to each bed, conveying the cut lengths from the first cooling bed and subjecting them to substantially automatic continuous after-processing and conveying the cut lengths from the second cooling bed, after intermediate storage subjecting them at the second cooling bed to at least partially manual individual after-processing.

2. A method as claimed in claim 1, in which unserviceable end portions of the material are severed by the severing device together with an adjoining section of serviceable material of at least commerical length and are fed to the second cooling bed and in which the individual after-processing includes the severing of the unserviceable end portions from such adjoining sections.

3. A method as claimed in claim 1 in which said plant includes a stretch-reducing rolling mill.

4. A method as claimed in claim 2 in which said plant includes a stretch reducing mill.

5. A method as claimed in claim 1 in which the material is straightened on the first cooling bed.

6. A method as claimed in claim 2 in which the material is straightened on the first cooling bed.

7. Apparatus for handling cut lengths of bar-shaped material discharged from a plant for manufacturing and/or machining same comprising first and second cooling beds, means for selectively separating said cut lengths into first and second groups, at least said first group having generally common characteristics different from the other group and transferring the first and second groups of cut lengths to the first and second cooling beds respectively, continuous after-processing equipment having substantially automatically operating devices and disposed to receive and process cut lengths from the first cooling bed, and individual after-processing equipment disposed to receive and process, with manual intervention, cut lengths from the second cooling bed.

8. Apparatus as claimed in claim 7, in which the first cooling bed comprises a straightening cooling bed.

9. Apparatus as claimed in claim 7 in which the straightening cooling bed is a roller cooling bed.

10. Apparatus as claimed in claim 7, further comprising a computer and associated measuring, testing and weighing devices arranged upstream of the cooling beds, the selective transferring means upstream of the cooling beds, being controlled by the computer in dependence upon the nature of the cut lengths of material.

11. Apparatus as claimed in claim 7 in which the individual after-processing equipment includes a severing device for severing unserviceable end portions from adjoining sections of serviceable material.

12. Apparatus as claimed in claim 7 in which the after-processing equipment includes a device for performing a machining operation on the ends of the cut lengths.

13. Apparatus as claimed in claim 7 in which the after-processing equipment includes a packaging device.

14. Apparatus as claimed in claim 7 in which the selective transferring means comprises at least one of a deflector, transfer levers and ejectors.

* * * * *